United States Patent [19]

Tranchero

[11] Patent Number: 4,770,271

[45] Date of Patent: Sep. 13, 1988

[54] TRANSPORTABLE, ARTICULATED-ARM CRANE

[76] Inventor: Jacques Tranchero, Via Ceretto, 56, 12024 Costiglionle Saluzzo, Cuneo, Italy

[21] Appl. No.: 28,607

[22] Filed: Mar. 20, 1987

[30] Foreign Application Priority Data

Apr. 14, 1986 [IT] Italy ..... 67308 A/86

[51] Int. Cl.[4] ..... B66F 11/04

[52] U.S. Cl. ..... 182/2; 212/261; 212/266

[58] Field of Search ..... 182/2, 63; 212/266, 212/255, 261

[56] References Cited

U.S. PATENT DOCUMENTS 3,708,037 1/1973 Tranchero ..... 182/2

4,667,771 5/1987 Tranchero ..... 182/2

*Primary Examiner*—Reinaldo P. Machado

*Attorney, Agent, or Firm*—Fiddler & Levine

[57] ABSTRACT

A transportable, articulated-arm crane comprising three hydraulically actuated members; the third member, considered from bottom to top, is articulated with a platform able to support persons and/or other objects; the articulated arms have a lever structure that is rendered lighter and reinforced by a struts designed so that the machine has considerably reduced dimensions when in the completely lowered position against the bed of the vehicle transporting it.

3 Claims, 8 Drawing Sheets

TRANSPORTABLE, ARTICULATED-ARM CRANE

DESCRIPTION

A transportable crane designed to lift a platform from a height of several meters to over 30 meters. The applicant also holds Italian Pats. No. 916.408, No. 1.044.964, and patent application No. 67204-A/82. In reference to the first two patents, these machines have a complex structure and have some operative drawbacks; the machine of the patent application can carry a maximum load of 1000 kg to considerable heights. All the aforementioned machines use at least four hydraulic members cooperating with articulated levers so that when the machines are in the fully lowered position with respect to the bed of the vehicle on which they are mounted they have dimensions preventing the entire device from being transported under some underpasses.

The main purpose of the present invention is to provide a transportable crane able to lift a platform with a maximum safe load of approximately 500 kg to a height of 30 meters, and having a total height when in the fully lowered position allowing it, together with the vehicle on which it is mounted, to travel under the underpasses of the prinicpal highways.

Another purpose of the invention is to provide a low-weight transportable crane having dimensions allowing it to be mounted on the bed of a vehicle with medium dimensions and wheelbase, which would be economically advantageous for the intended applications of the crane.

A further purpose of the invention is to provide a lifting machine having a very low center of gravity allowing high speed operations and a wide radial range.

The transportable crane described herein comprises a total of three hydraulic members associated with articulated levers; said members can be actuated individually by corresponding hydraulic cylinders; the machine's lever mechanisms are designed and arranged so they stack vertically overlapping with each other resulting in a device having minimal height; the base of the platform lowers to the level of the vehicle's loading bed on which the crane is mounted considerably facilitating platform loading operations.

The invention will be described further, by way of example, with reference to the accompanying drawings in which.

Figure 6:
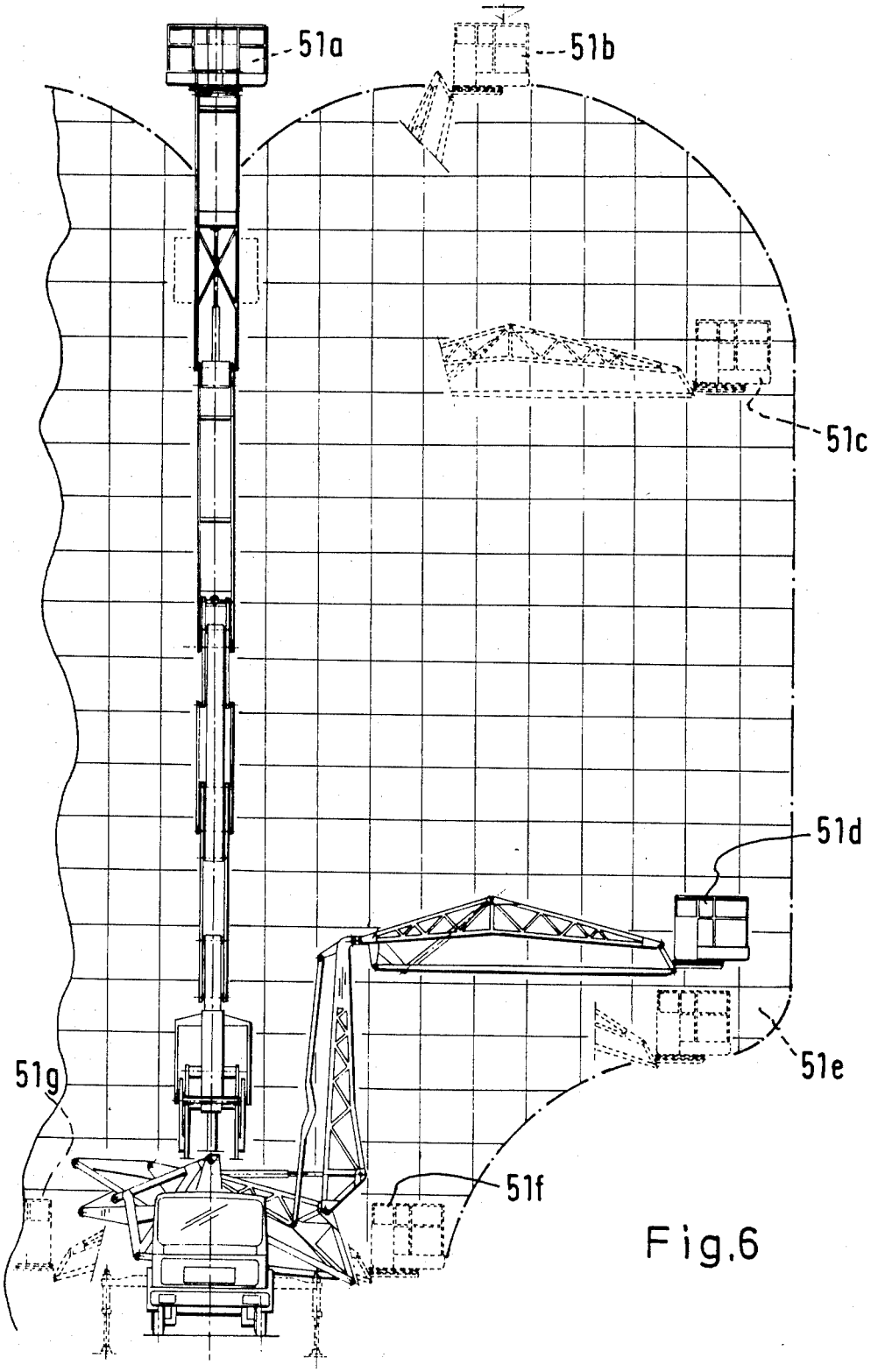
Figures 7, 8:
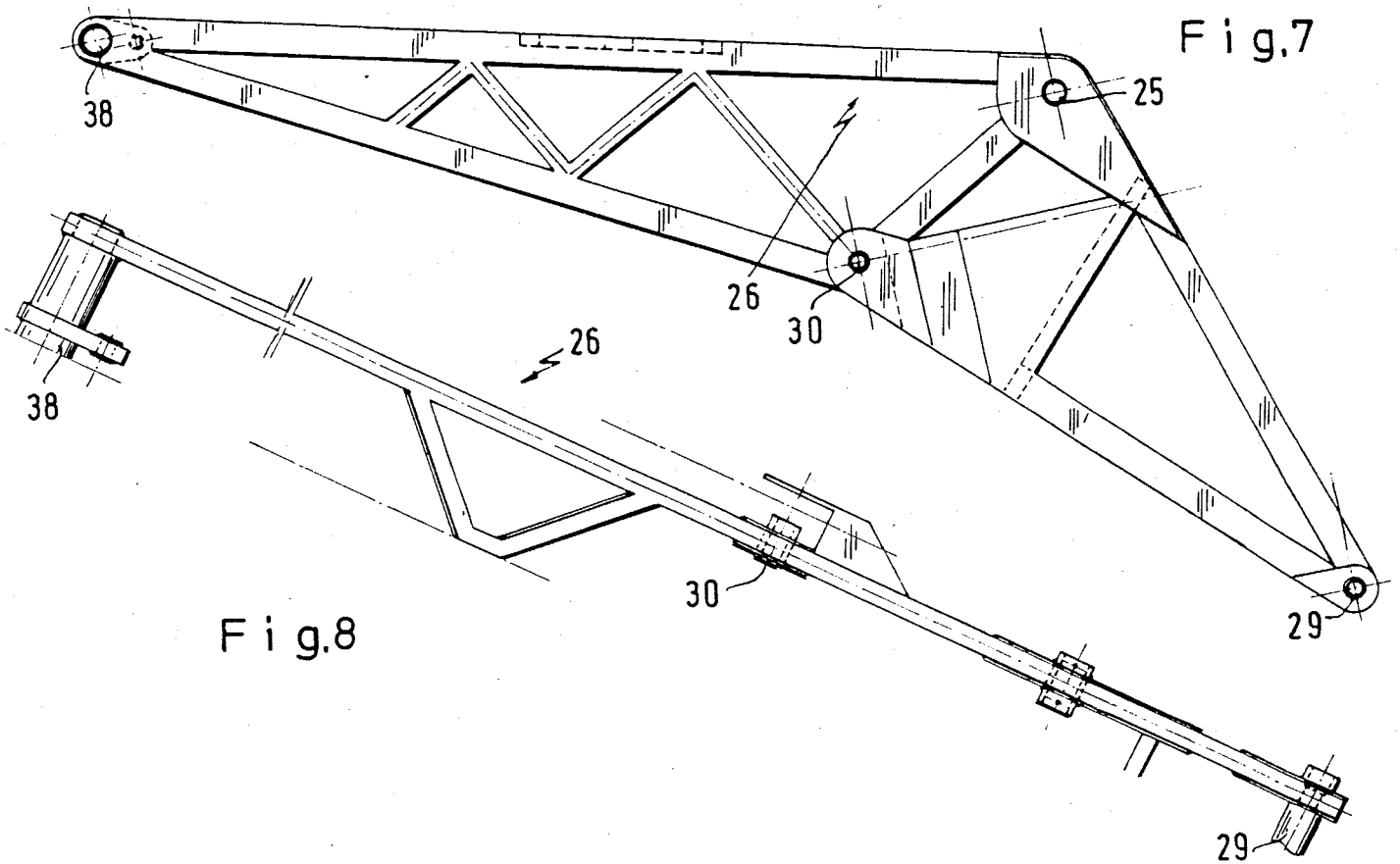
Figures 9, 10:
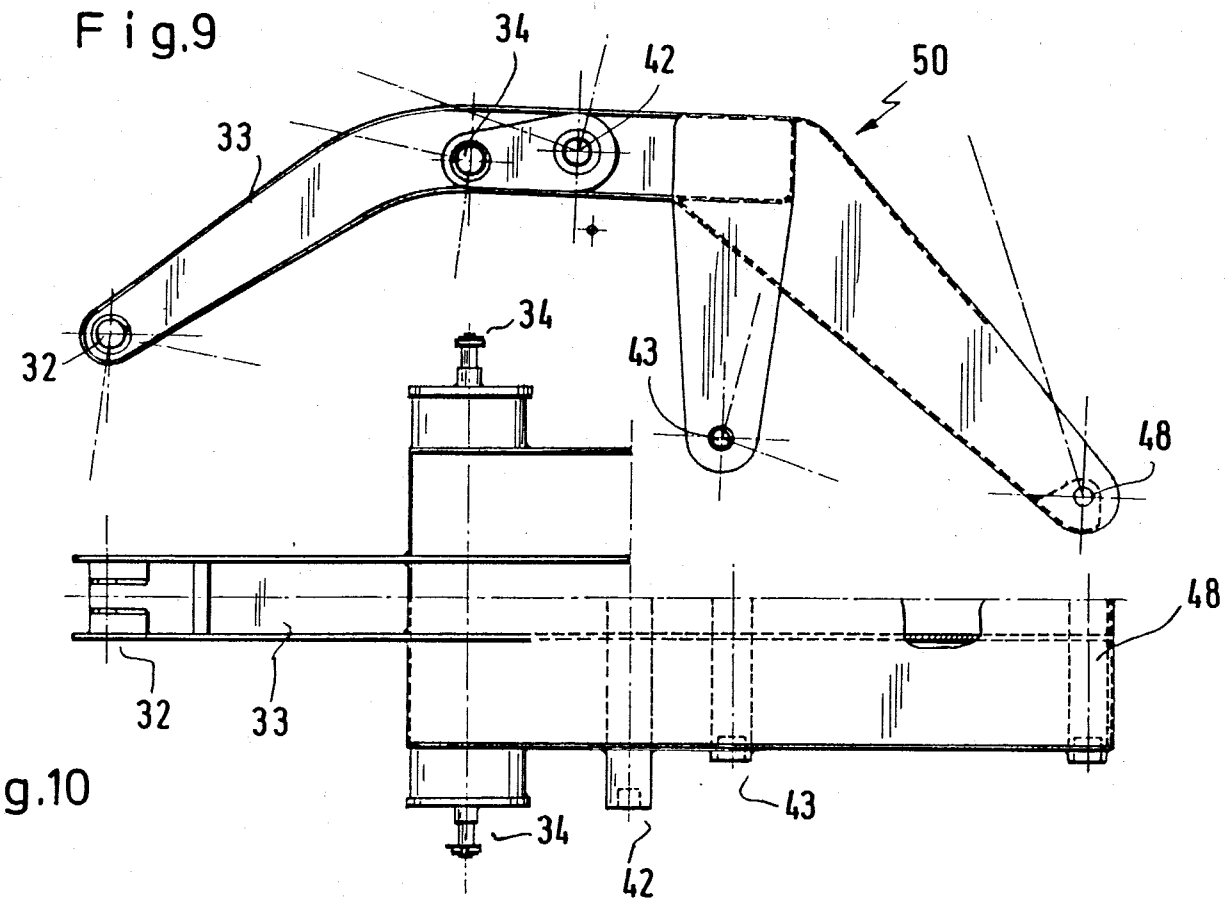

FIG. 6 schematically illustrates, at a different scale, both the polar and radial range of operation of the crane capable of an angular movement of over 360°;

FIGS. 7 and 8 are a side and partial planar view respectively of a lever hereinbelow called "cradle";

FIGS. 9 and 10 are a side and partial planar view respectively showing the structure of a lever hereinbelow called "countercradle".

Figure 1:
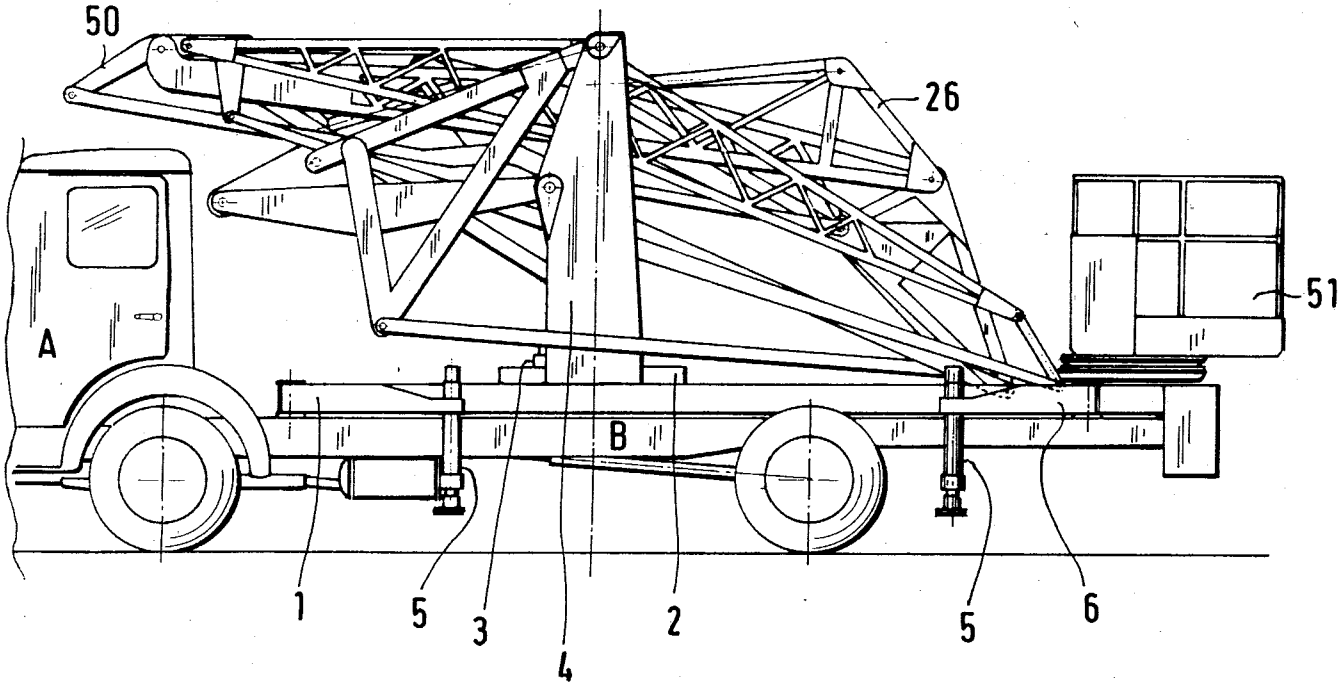
FIG. 1 shows the crane in the fully lowered position mounted on a medium-sized truck.
Figure 2:
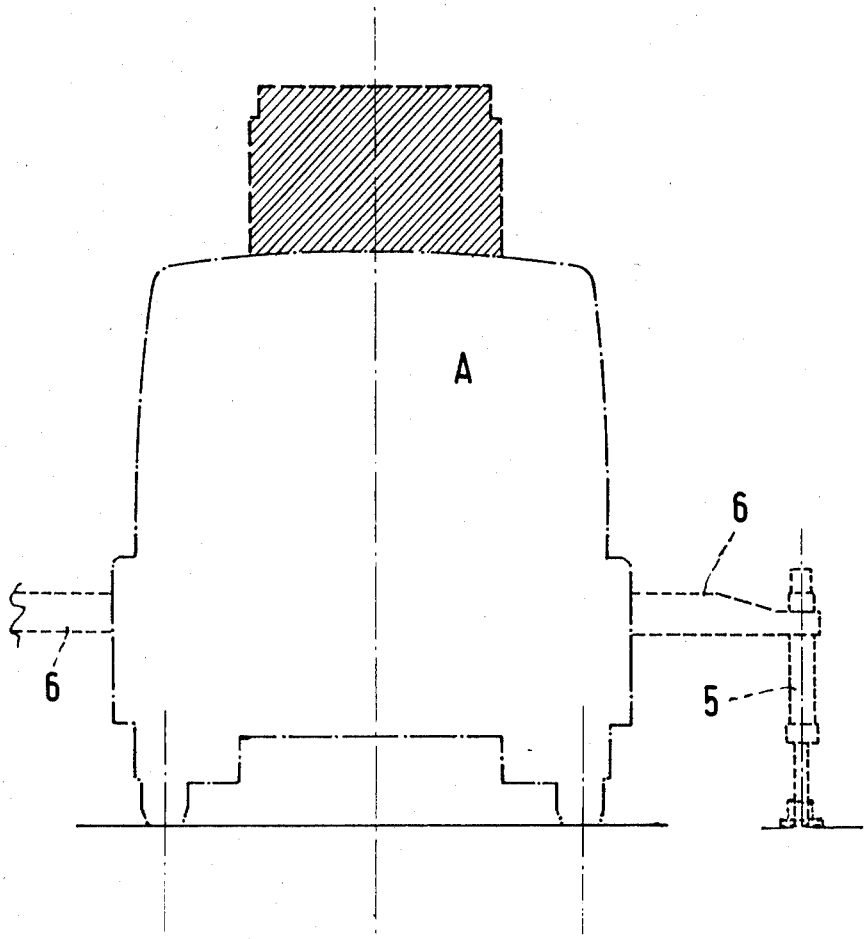
FIG. 2 is a frontal view schematically illustrating the vertical dimensions of the crane/vehicle combination with the crane in the fully lowered position.

In reference to FIGS. 1 and 2, -A- indicates a medium-sized truck having a bed -B- on which the present invention is mounted. Base 1 provides a foundation for annular support 2 of turret 4 which is connected to it; together they can rotate over 360° actuated by a hydraulic mechanism 3. 5 indicates four jacks designed to rest on the ground as shown in FIG. 4 when the crane is operating; said jacks are associated with arms 6 articulated with respect to the chassis of the truck so they can swing out with respect to said chassis as illustrated in FIGS. 2 and 4.

FIGS. 1 and 2 clearly illustrate that the crane when fully lowered is only slightly higher than the cab of vehicle -A- on which it is mounted, while the base of platform 51 is practically at the same level as the loading bed of the vehicle.

Figure 3:
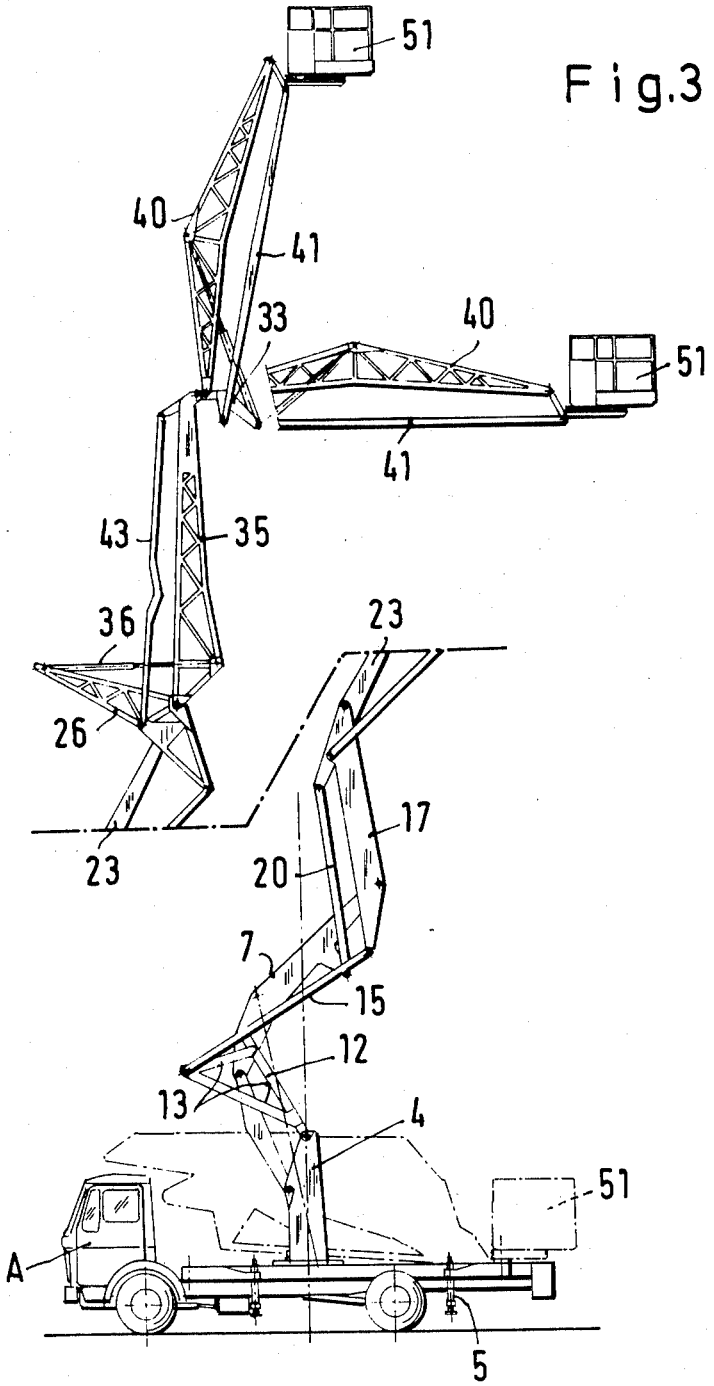
FIG. 3 is a side view of the crane, at a different scale, showing the platform at maximum extension and at an intermediate position.
Figure 4:
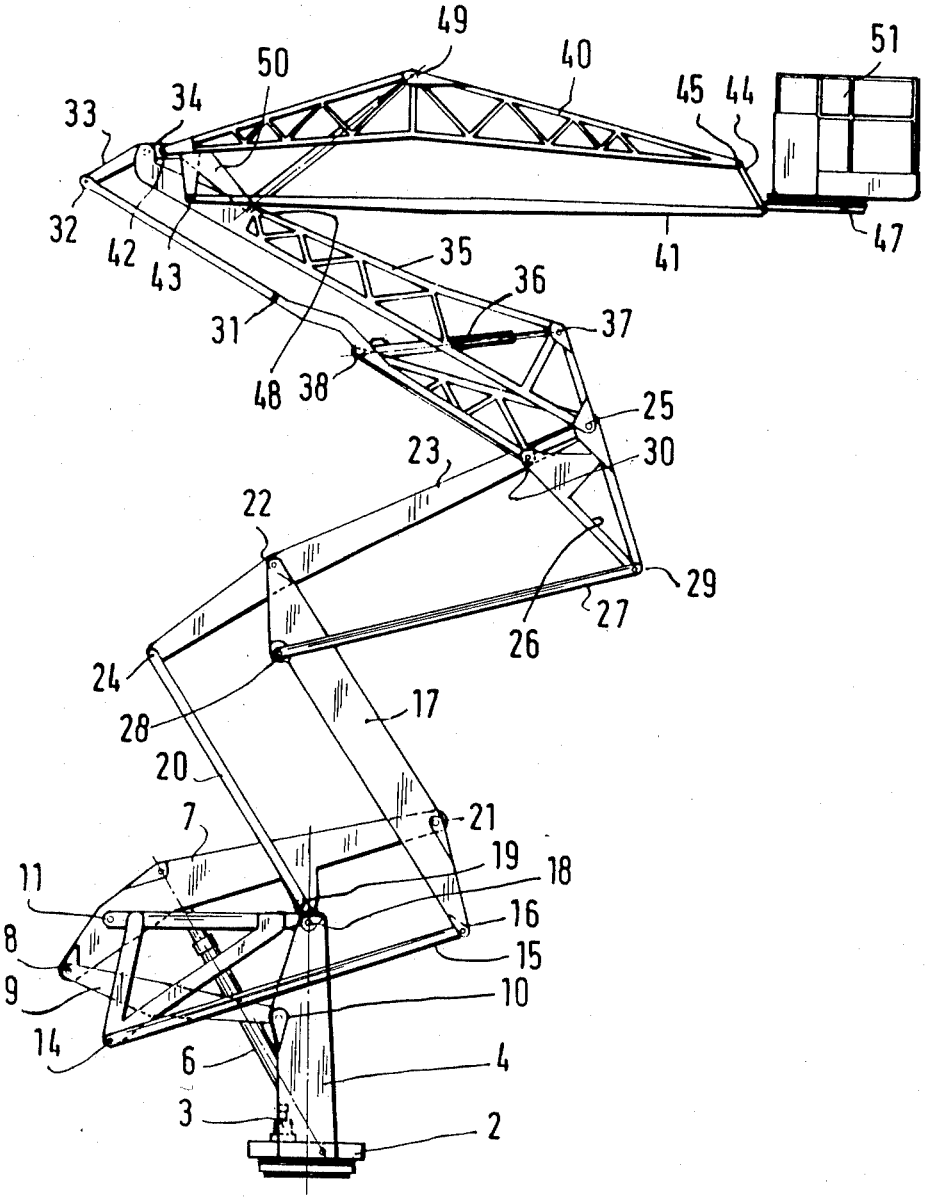
FIG. 4 is a side view of the crane alone at an intermediate position.
Figure 5:
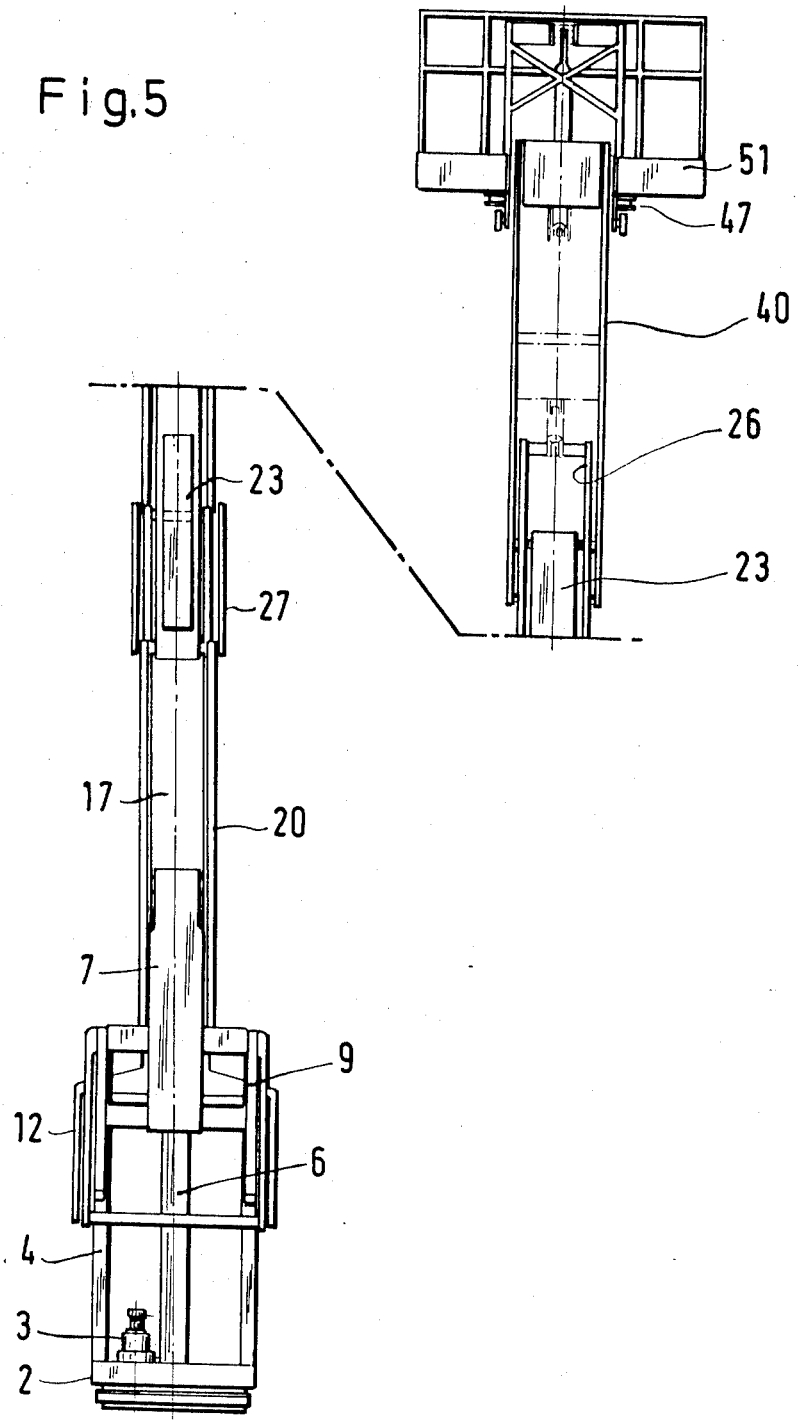
FIG. 5 is a frontal view of the crane.

In reference to FIGS. 3, 4, and 5, the first member of the crane is actuated by the piston of hydraulic cylinder 6 which is articulated at support 2, integral with turret 4, and at lifting arm 7, which in turn is articulated at point 8 with lever 9, which is articulated with turret 4 at 10. Said arm 7 is articulated with a stabilizing element 12 made up of integral arms 12 and 13. All the components described have twin, symmetric elements; stabilizer 12 can be considered to be a triangle with vertex 14 articulated at one end with connecting rod 15 and at the other with lever 17. Said stabilizer 12 is articulated with turret 4 at point 18. Lifting arm 7 is articulated with strut 20 at 19, and rocker lever 17 is articulated at 21 with arm 7. Said strut 20 and rocker arm 17 form a second lifting member, while all the other elements previously described form the first lifting member; the first and second members are actuated by hydraulic cylinder 6. One end of rocker lever 17 is articulated with the second rocker lever 23 at 22; said second rocker lever is articulated at one end at 24 with strut 20 and at the other end with cradle 26 at point 25 (FIGS. 4,7,8). A pair of symmetric rods 27 is articulated at 28 with rocker lever 17 and at 29 with a vertex of cradle 26. A pair of integral struts 31 are articulated at the median area of cradle 26; the opposite ends of said struts 31 are articulated at 32 with countercradle 33 (FIGS. 1 and 4).

In the intermediate position with respect to countercradle 33, one end of radial lever 35 is articulated at 34; its opposite end is articulated at point 25 with cradle 26; a first parallelogram is formed by the elements comprising the second hydraulic member. Said member can be actuated by the piston of hydraulic cylinder 36; said cylinder 36 is articulated with radial lever 35 at point 37 and with a vertex of cradle 26 at point 38.

The third hydraulic member, actuated by hydraulic cylinder 39, comprises terminal arm 40 and push rod 41, which are articulated with countercradle 33 at points 42 and 43. This configuration, together with frame 44 which is hinged at point 45 with one end of terminal lever 40, and at the other end with one end of push rod 41, forms a second parallelogram with articulating vertices, which is part of the third hydraulic member of the machine. Frame 44 is integral with base 47, which supports a rotation assembly comprising a pivot and a hydraulic actuator allowing the angular movement of platform 51 with respect to its vertical axis.

Hydraulic cylinder 39 is articulated at point 48 with projection 50 of countercradle 33 and at point 49 in the middle of terminal lever 40. Thanks to the configuration of the elements described and hydraulic system comprising three hydraulic cylinder (6, 36, and 39) raising and lowering the three members can be governed separately or at the same time depending on the needs of the operator. When platform 51 is at its maximum extension as illustrated in FIG. 6 (said platform can be maneuvered to positions 51*a*, 51*b*, 51*c*, 51*d*, 51*e*, 51*f*, 51*g* or any intermediate position) the center of gravity of the machine when fully loaded always remains within the quadrilateral perimeter defined by the points where the four jacks 5 rest when they are in their fully extended position with respect to the chassis of vehicle -A-, as shown in FIGS. 2 and 6.

The triangular configuration of cradle 26 having a horizontal axis of articulation at 25 also shared by the second rocker lever 23, together with the lateral arrangement of struts 43 form structural elements essential for limiting the total length of the machine when in the resting position (FIG. 1). The reduced vertical dimensions of the machine are mainly due to the configuration of countercradle 33 which extends into the twin arms of the first member through the ends of the first 17 and second 33 rocker levers.

All the arms and levers described comprise twin elements, as shown in FIGS. 5 and 6. The geometric configuration and points of articulation are the result of precise calculations and extensive practical testing.

The features of the present crane can be summarized as follows:

Elevation of platform 51 to a height of approximately 30 meters.

The machine has limited vertical and horizontal dimensions when in the resting position allowing the use of medium-sized trucks.

Extremely wide radial platform range when fully extended and loaded.

Low total crane weight with respect to machines offering similar performance.

Platform positioning is extremely rapid.

I claim:

1. A transportable, articulated-arm crane comprising three lifting members actuated by three hydraulic cylinders (6,36,39) and associated pistons, in which the first hydraulic cylinder (6), in order of height from bottom to top, being articulated with respect to a support (2) and turret (4) of the machine, and with respect to an articulated arm (7) hinging, in turn, with a first arm (9) and a second arm (12,13) forming a triangle; said second arm being also articulated with a connecting rod (15), in turn articulating with a rocker lever (17) cooperating with a strut (20), both of which being articulated with a second rocker lever (23); said latter rocker lever (23) and a pair of symmetric rods (27) being articulated with another triangular element called "cradle"; said cradle being articulated with a pair of struts (31) and a radial arm (35) articulating with a second element called "countercradle" which, in turn being articulated with a push rod (41) and a terminal arm, both articulating with a frame (44) having a base (47) where a loading platform (51) is mounted.

2. A transportable crane as claimed in claim 1, in which the countercradle (50) comprises a middle arm that articulates with a push rod (41) which, together with a frame (44), determines the constant horizontal orientation of a platform (51).

3. A transportable crane as claimed in claim 1, in which the base (47) of a platform (51) comprises a pivot for rotation of the cabin or guard rail mounted on said base with respect to its vertical axis.

* * * * *